US012516660B2

(12) United States Patent
Waldschmidt et al.

(10) Patent No.: US 12,516,660 B2
(45) Date of Patent: Jan. 6, 2026

(54) REMANUFACTURED YOKE FOR FUEL PUMP

(71) Applicant: Caterpillar Inc., Peoria, IL (US)

(72) Inventors: Derek Leonard Waldschmidt, Chillicothe, IL (US); Ronald Lucas Sale, Mapleton, IL (US); Michael Eugene Watts, Mapleton, IL (US); Cody Scott Gaffner, Chillicothe, IL (US)

(73) Assignee: Caterpillar Inc., Peoria, IL (US)

( * ) Notice: Subject to any disclaimer, the term of this patent is extended or adjusted under 35 U.S.C. 154(b) by 82 days.

(21) Appl. No.: 18/537,900

(22) Filed: Dec. 13, 2023

(65) Prior Publication Data

US 2025/0198397 A1 Jun. 19, 2025

(51) Int. Cl.
*F04B 1/0404* (2020.01)
*F04B 53/16* (2006.01)

(52) U.S. Cl.
CPC ..... *F04B 1/0404* (2013.01); *F04B 53/16* (2013.01)

(58) Field of Classification Search
CPC ..... F04B 1/2078; F04B 1/2085; F01B 3/007; F03C 1/0668
USPC ..... 74/60
See application file for complete search history.

(56) References Cited

U.S. PATENT DOCUMENTS

| | | | | |
|---|---|---|---|---|
| 3,605,565 | A | 9/1971 | Berezinski | |
| 3,641,829 | A | 2/1972 | Reynolds | |
| 3,996,841 | A * | 12/1976 | Gostomski, Jr. | F04B 1/2078 91/499 |
| 5,515,829 | A | 5/1996 | Wear et al. | |
| 5,704,272 | A * | 1/1998 | Durako, Jr. | F01B 3/007 91/499 |
| 5,833,369 | A * | 11/1998 | Heshmat | F16C 17/042 384/106 |
| 2006/0280618 | A1 | 12/2006 | Awwad et al. | |
| 2020/0182228 | A1* | 6/2020 | Rittmeyer | F03C 1/0668 |

FOREIGN PATENT DOCUMENTS

GB 2274491 A 7/1994

OTHER PUBLICATIONS

Written Opinion and International Search Report for Int'l. Patent Appln. No. PCT/US2024/056986, mailed Feb. 24, 2025 (12 pgs).

* cited by examiner

*Primary Examiner* — Kenneth J Hansen

(57) ABSTRACT

A remanufactured yoke for a fuel pump includes a body having a base and a sidewall extending orthogonally from the base. The base and the sidewall together define a receiving space. The sidewall defines an inner surface facing the receiving space and an outer surface opposite the inner surface. The remanufactured yoke also includes a wear plate removably disposed within the receiving space defined by the base and the sidewall. The wear plate is in contact with the base of the body. The remanufactured yoke further includes a coupling member coupled with the body and the wear plate to prevent a rotational movement of the wear plate relative to the body.

19 Claims, 8 Drawing Sheets

REMANUFACTURED YOKE FOR FUEL PUMP

TECHNICAL FIELD

The present disclosure relates to a fuel pump, a remanufactured yoke for the fuel pump, and a method of remanufacturing a yoke for the fuel pump.

BACKGROUND

Internal combustion engines are equipped with a hydraulically-actuated fuel injection system (HEUI fuel system) that employs a fuel pump for providing actuating fluid at elevated pressures to injectors of the engines. The fuel pump includes a number of pistons, a housing, and a yoke. The pistons and the yoke are received within the housing. The yoke is pivotally disposed in the housing and is movable through a range of angular positions for controlling the stroke length of the pistons, thereby controlling a fluid output of the fuel pump.

The yoke may be subjected to wear and tear during operation of the fuel pump. The yoke is limited in lifetime due to premature wear and tear from operation. The yoke includes a layer of nitride which, if penetrated, renders the yoke unusable. As the yoke may be expensive, replacement of the entire yoke may increase servicing and replacement costs of the engine, which may not be desirable.

U.S. Pat. No. 5,704,272 describes an improved axial-piston energy converting device which is provided by utilizing a thin ceramic wear plate insert, having a typical thickness of only about 0.005 to 0.040 inches, as a cam surface secured by atmospheric pressure to an underlying support surface of a steel cam plate support structure. Attachment of the wear plate to the cam plate supporting surface is accomplished by polishing both a supporting surface of the cam plate, and a mating surface of the wear plate to a very smooth finish, and wiping a thin film of a fluid such as oil onto one of the polished surfaces prior to placing the wear plate onto the supporting surface. The highly polished surfaces, together with the light film of oil, result in a joint that is essentially air-tight. Atmospheric pressure acting on the cam surface of the wear plate serves to hold the wear plate tightly in place on the support surface in the same manner that a pair of Johansson blocks are held together if their highly polished surfaces mate.

SUMMARY OF THE DISCLOSURE

In an aspect of the present disclosure, a remanufactured yoke for a fuel pump is provided. The remanufactured yoke includes a body having a base and a sidewall extending orthogonally from the base. The base and the sidewall together define a receiving space. The sidewall defines an inner surface facing the receiving space and an outer surface opposite the inner surface. The remanufactured yoke also includes a wear plate removably disposed within the receiving space defined by the base and the sidewall. The wear plate is in contact with the base of the body. The remanufactured yoke further includes a coupling member coupled with the body and the wear plate to prevent a rotational movement of the wear plate relative to the body.

In another aspect of the present disclosure, a fuel pump is provided. The fuel pump includes a pump housing. The fuel pump also includes a remanufactured yoke removably coupled to the pump housing and pivotable about a yoke axis. The remanufactured yoke includes a body having a base and a sidewall extending orthogonally from the base. The base and the sidewall together define a receiving space. The sidewall defines an inner surface facing the receiving space and an outer surface opposite the inner surface. The remanufactured yoke also includes a wear plate removably disposed within the receiving space defined by the base and the sidewall. The wear plate is in contact with the base of the body. The remanufactured yoke further includes a coupling member coupled with the body and the wear plate to prevent a rotational movement of the wear plate relative to the body.

In yet another aspect of the present disclosure, a method of remanufacturing a yoke for a fuel pump is provided. The method includes providing the yoke including a body. The body has a base and a sidewall extending orthogonally from the base. The base and the sidewall together define a receiving space. The method also includes removing a predetermined layer of material from the base of the body. The method further includes providing a wear plate having a thickness corresponding to a thickness of the predetermined layer of material removed from the base. The method includes disposing the wear plate within the receiving space defined by the base and the sidewall, such that the wear plate contacts the base of the body. The method also includes receiving a coupling member within the wear plate and the base. The method further includes preventing a rotational movement of the wear plate relative to the body based on receipt of the coupling member within the wear plate and the base.

Other features and aspects of this disclosure will be apparent from the following description and the accompanying drawings.

DETAILED DESCRIPTION

Wherever possible, the same reference numbers will be used throughout the drawings to refer to the same or like parts.

Figure 1:
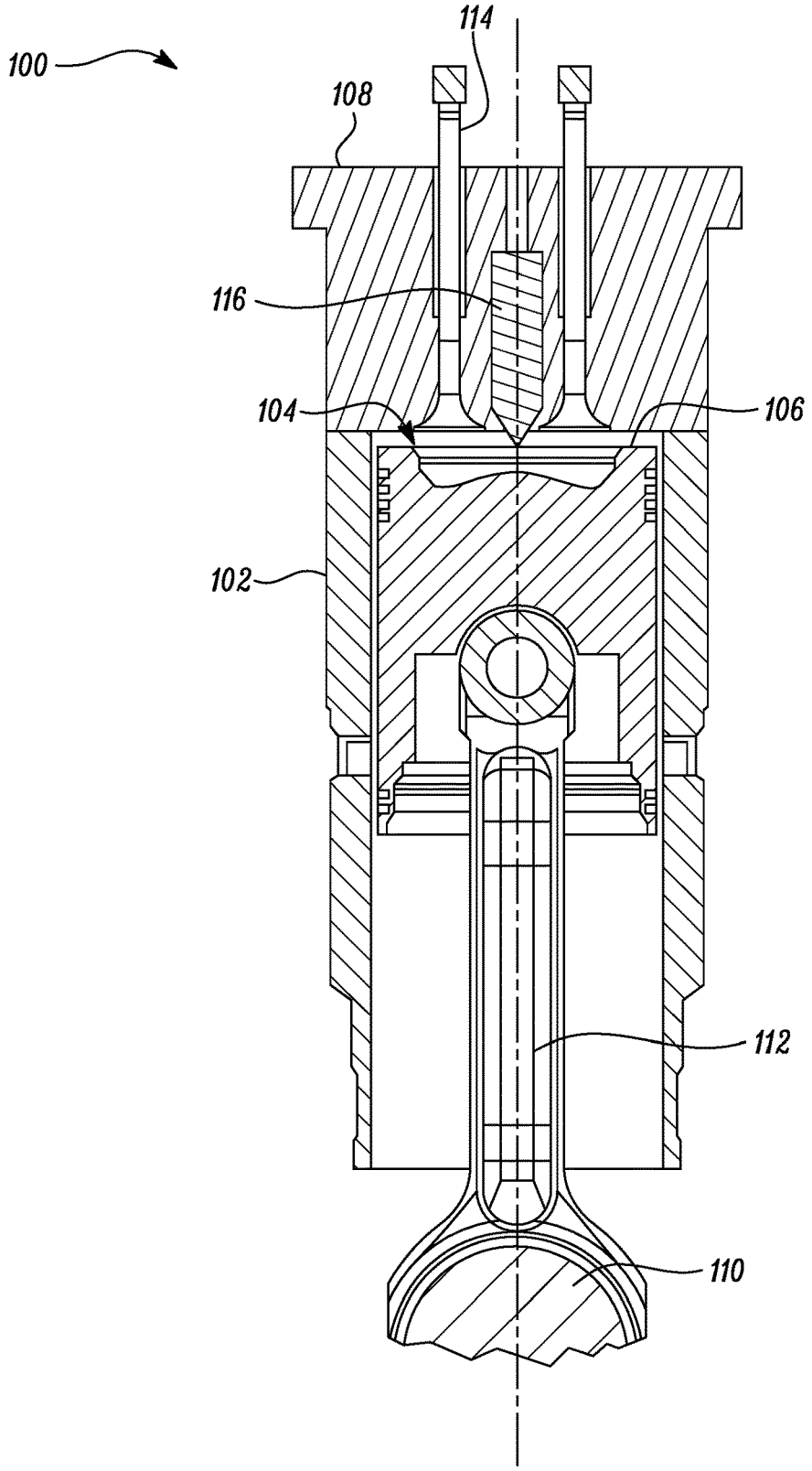
FIG. 1 is a schematic cross-sectional view of an exemplary engine system.

FIG. 1 is a schematic view of an exemplary engine system 100. The engine system 100 may be associated with various machines. The machine may be a stationary machine or a mobile machine. The machine may be an excavator, a truck, a dozer, a wheel loader, a track-type tractor, a motor grader, and the like, that may be used for various purposes, such as digging, construction, landscaping, and the like in various industries. It should be noted that the present disclosure is equally applicable to any type of internal combustion engines, such as V-type engines, in-line cylinder engines, and rotary engines.

The engine system 100 includes one or more engine cylinders 102. Each engine cylinder 102 defines a cylinder bore 104 therethrough, a piston 106 slidably disposed within the cylinder bore 104, and a cylinder head 108 disposed on top of the engine cylinder 102. The piston 106 is operably coupled to a crankshaft 110 (shown in part) through a connecting rod 112. Although only one engine cylinder 102 is shown in FIG. 1, the engine system 100 may include a number of engine cylinders 102, as would be appreciated by persons having ordinary skill in the art. The cylinder head 108 includes at least one exhaust valve 114 that is actuated by a cam (not shown), hydraulics (not shown), or other means. When the at least one exhaust valve 114 is in an open position, the cylinder bore 104 is in fluid communication with an exhaust manifold (not shown) through the cylinder head 108.

The engine system 100 includes a fuel injector 116 in fluid communication with the cylinder bore 104. The fuel injector 116 is supplied with a fuel that readily ignites at air pressures and temperatures achieved near a top of a compression stroke of the piston 106 within the cylinder bore 104. The fuel may include, for example, diesel, bio-diesel, dimethyl either (DME), kerosene, seed oils, and other fuels with similarly high cetane indices known by persons with ordinary skill in the art. The fuel injector 116 receives fuel via a fuel pump 200 (shown in FIG. 2). The fuel pump 200 includes a hydraulically-actuated electronically-controlled (HEUI) fuel pump as described herein.

Figure 2:
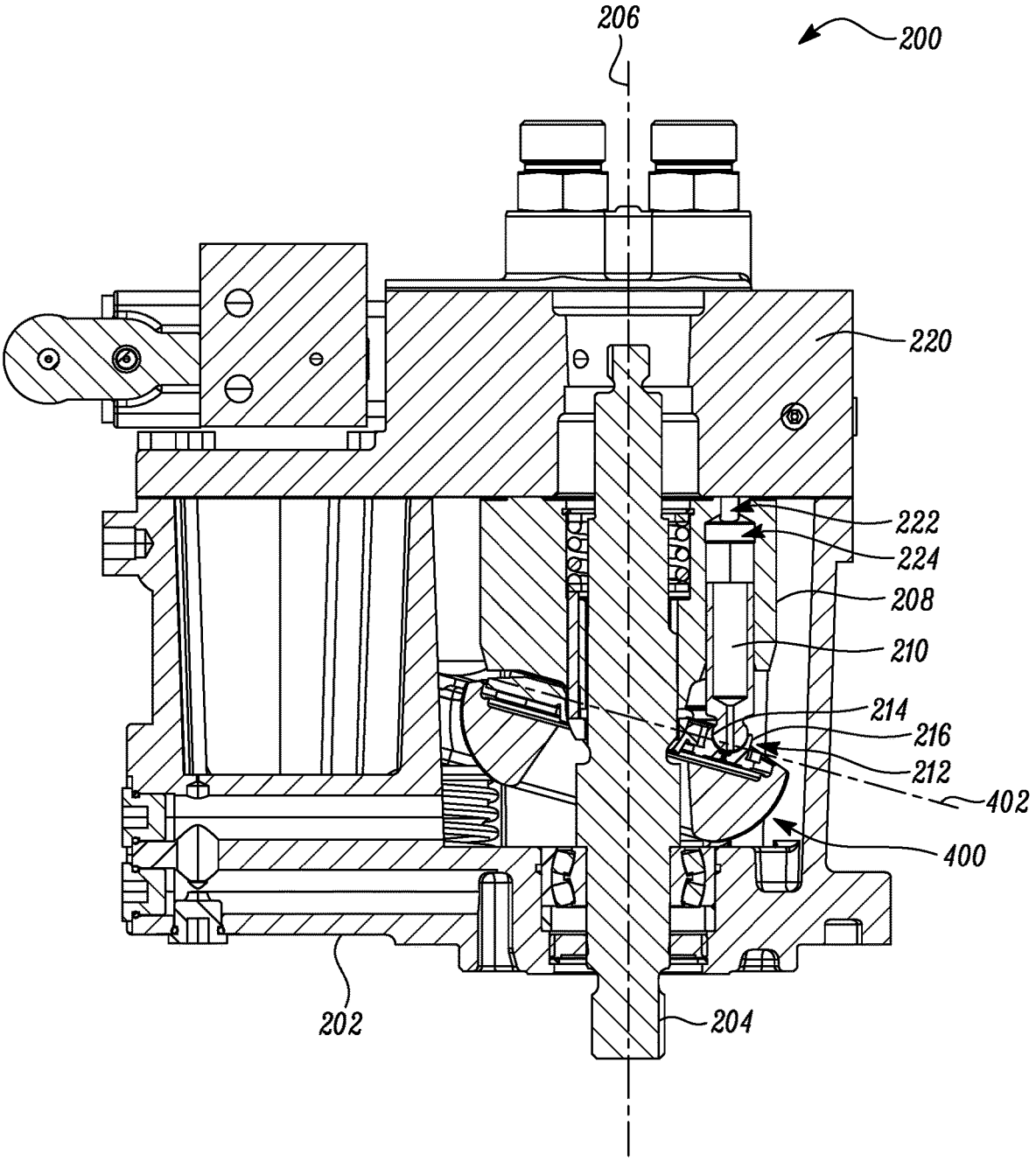
FIG. 2 is a schematic cross-sectional view of an exemplary fuel pump associated with the engine system of FIG. 1 having a remanufactured yoke, according to an example of the present disclosure.

Referring now to FIG. 2, a schematic cross-sectional view of the fuel pump 200 is illustrated. The fuel pump 200 includes a pump housing 202 with a pump shaft 204 rotatably disposed therein for rotation about a pump axis 206. A block 208 is engaged with the pump shaft 204 for rotation therewith by axial splines (not shown). The block 208 has one or more pistons 210, for example nine, disposed therein for axial movement parallel to the pump axis 206. One end 212 of each piston 210 is spherical shaped and is disposed in a socket 214 of a shoe 216.

Figure 3:
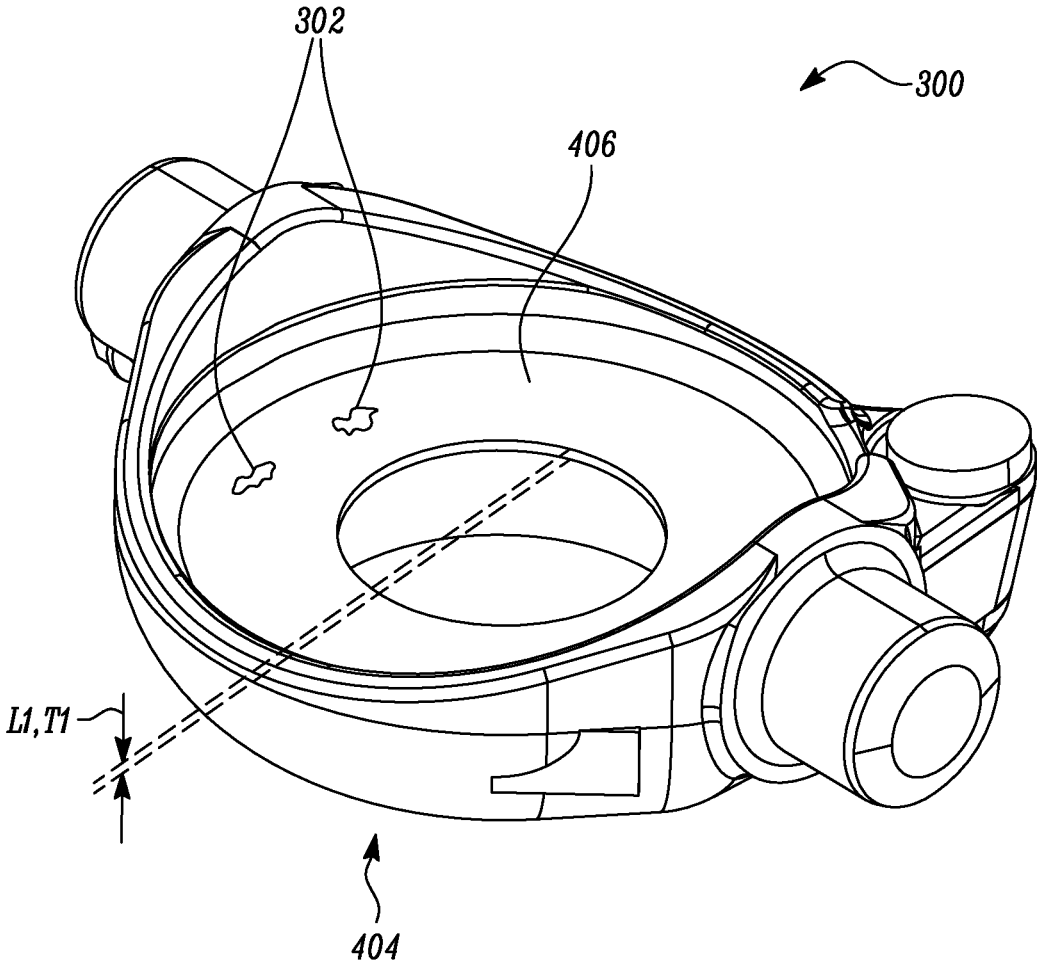
FIG. 3 is schematic perspective view of an exemplary body of a core yoke (before remanufacturing) associated with the fuel pump of FIG. 2, wherein the core yoke includes damaged portions.

The fuel pump 200 also includes a remanufactured yoke 400 removably coupled to the pump housing 202 and pivotable about a yoke axis 402. Specifically, a core yoke 300 (as shown in FIG. 3) of the fuel pump 200 is remanufactured to form the remanufactured yoke 400 that is disposed in the fuel pump 200 of FIG. 2. The remanufactured yoke 400 may be hereinafter interchangeably referred to as "yoke 400". A side of the shoes 216 opposite the socket 214 is slidably disposed against a race surface of the remanufactured yoke 400. The remanufactured yoke 400 is pivotally disposed in the pump housing 202 and in known fashion is movable through a range of angular positions for controlling the stroke length of the pistons 210, thereby controlling a fluid output of the fuel pump. 200

The remanufactured yoke 400 pivots about the yoke axis 402 but does not rotate about pump axis 206. The position of the remanufactured yoke 400 may be selectively adjustable to a range of angular positions between and inclusive of a minimum pump displacement and a maximum pump displacement, as per application requirements. An end cover portion 220 of the pump housing 202 has an intake port (not shown) through which actuating fluid enters piston cavities 222 and an output port 224 through which fluid exits the piston cavities 222.

Referring now to FIG. 3, the core yoke 300 includes a body 404. The body 404 has a base 406. The base 406 includes one or more damaged portions 302 thereon. A predetermined layer of material L1 having a thickness T1 is removed from the base 406. It should be noted that the predetermined layer of material L1 that is removed includes the damaged portions 302. In some examples, the core yoke 300 may undergo a material removal process, such as, machining, milling, or laser processing, to remove the predetermined layer of material L1 therefrom. In some cases, the predetermined layer of material L1 may be at least partially include a layer that is made of nitride.

Figure 4:
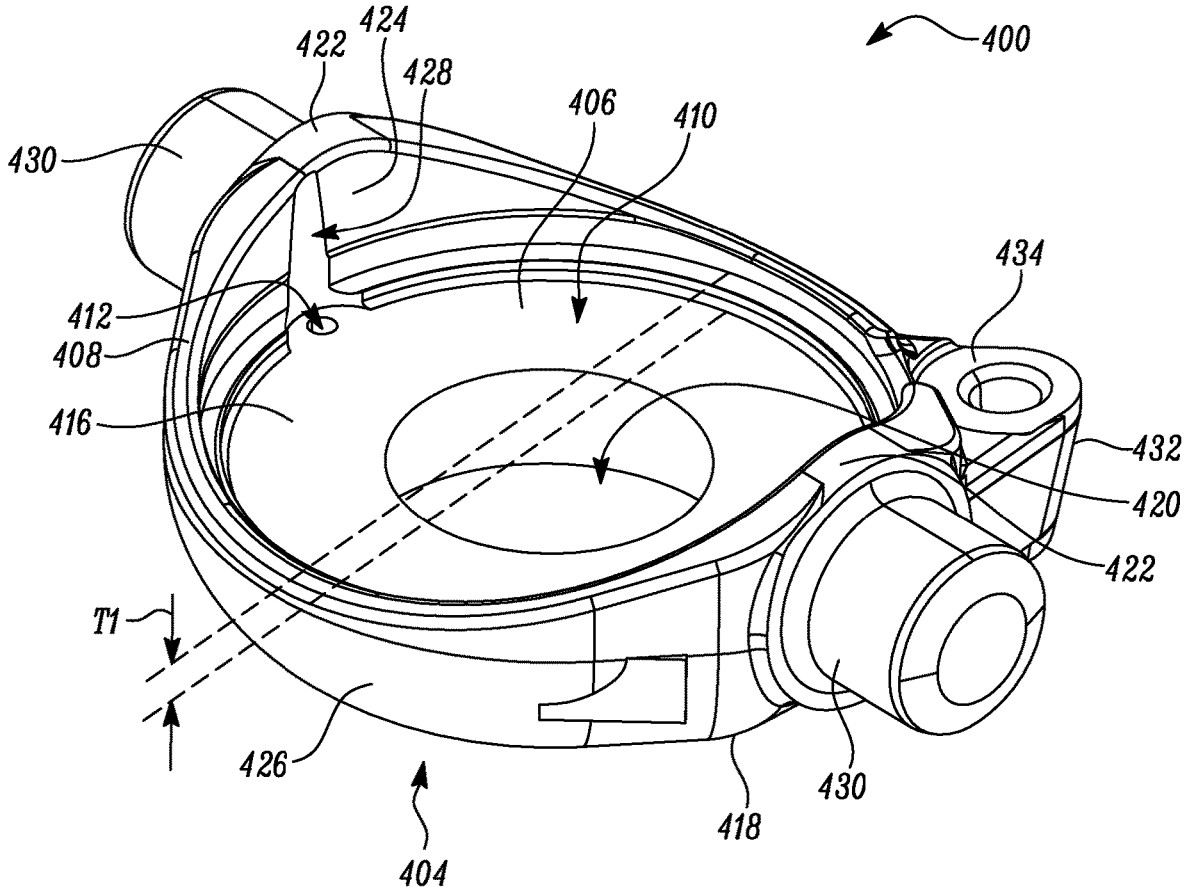
FIG. 4 is a schematic perspective view of the body of the remanufactured yoke of FIG. 2.

Referring now to FIG. 4, the remanufactured yoke 400 includes the body 404 having the base 406 and a sidewall 408 extending orthogonally from the base 406. It should be noted that the body 404 shown in FIG. 4 is similar to the body of FIG. 3, but the body 404 is formed by removing the predetermined layer of material L1 (see FIG. 3) having the thickness T1 from the base 406.

The base 406 and the sidewall 408 together define a receiving space 410. The opening 412 may be formed by any material removal process, for example, drilling, milling, or laser processing. Further, the base 406 defines an opening 412 to at least partially receive a coupling member 414 (shown in FIGS. 6 and 7) therein. The opening 412 is embodied as a tapped hole herein. The base 406 also defines an upper surface 416, a lower surface 418, and a first central opening 420 extending from the upper surface 416 to the lower surface 418.

The sidewall 408 defines a pair of raised portions 422. Further, the sidewall 408 defines an inner surface 424 facing the receiving space 410 and an outer surface 426 opposite the inner surface 424. Furthermore, the inner surface 424 of the sidewall 408 defines a notch 428 proximal to the opening 412 in the base 406. Specifically, the notch 428 is defined on the inner surface 424 of one of the raised portions 422 of the sidewall 408. The notch 428 is in communication with the receiving space 410 and surrounds the opening 412. The notch 428 may be formed by any material removal process, for example, by drilling, milling, or laser processing.

Further, the remanufactured yoke 400 has a pair of posts 430 for supporting the remanufactured yoke 400 in a manner allowing pivoting about the yoke axis 402 (see FIG. 2) in the pump housing 202. The posts 430 are cylindrical in shape. The remanufactured yoke 400 includes two posts 430 extending from the outer surface 426 of the sidewall 408. Each post 430 is coupled to a corresponding raised portion 422 of the sidewall 408 of the body 404. The remanufactured yoke 400 also includes a projection 432 extending from the outer surface 426 of the sidewall 408. The projection 432 defines an engagement surface 434. The engagement surface 434 of the yoke 400 is disposed between a yoke return spring (not shown) and a control or apply piston (not shown) which cooperate to pivotally position the yoke 400 to control pump displacement. The engagement surface 434 is relatively flat.

Figure 5:
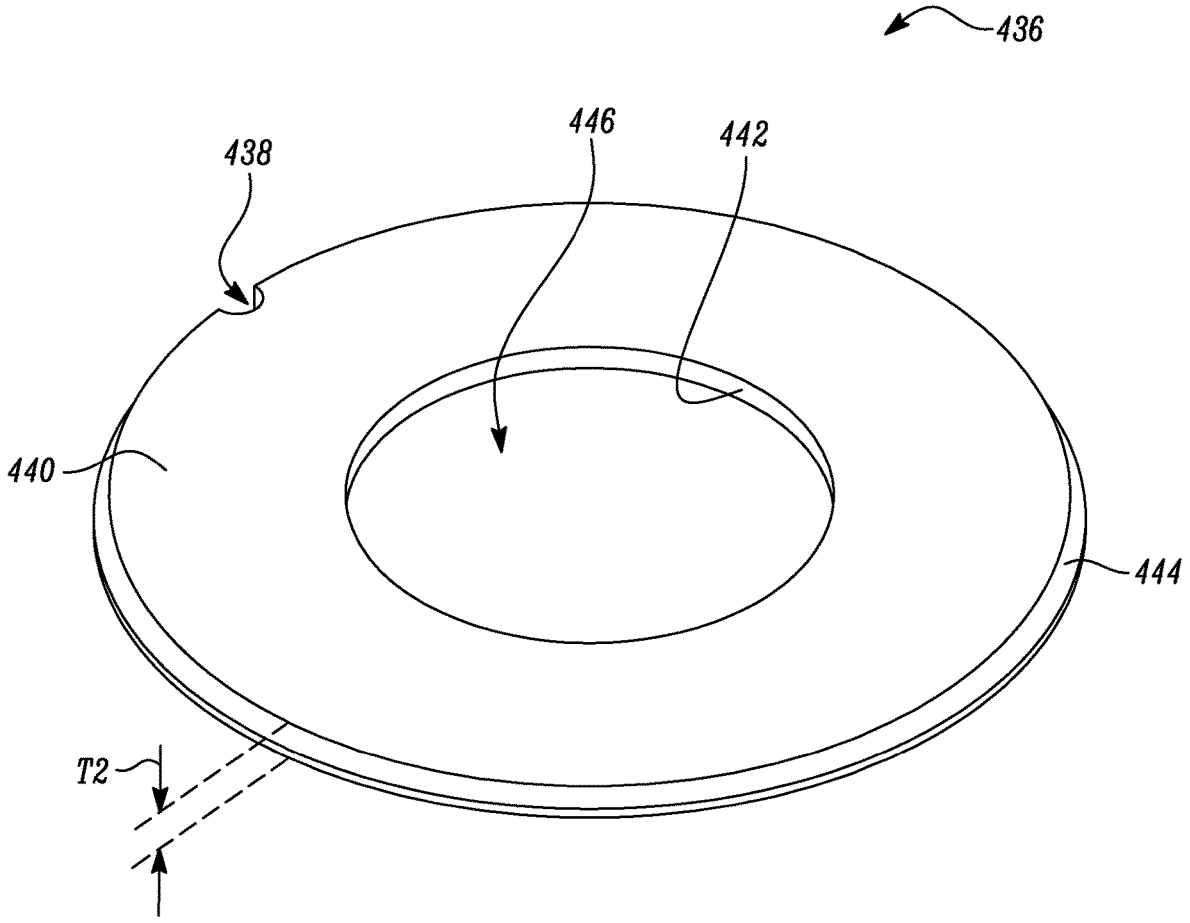
FIG. 5 is a schematic perspective view of a wear plate for the remanufactured yoke of FIG. 2, according to an example of the present disclosure.
Figure 6:
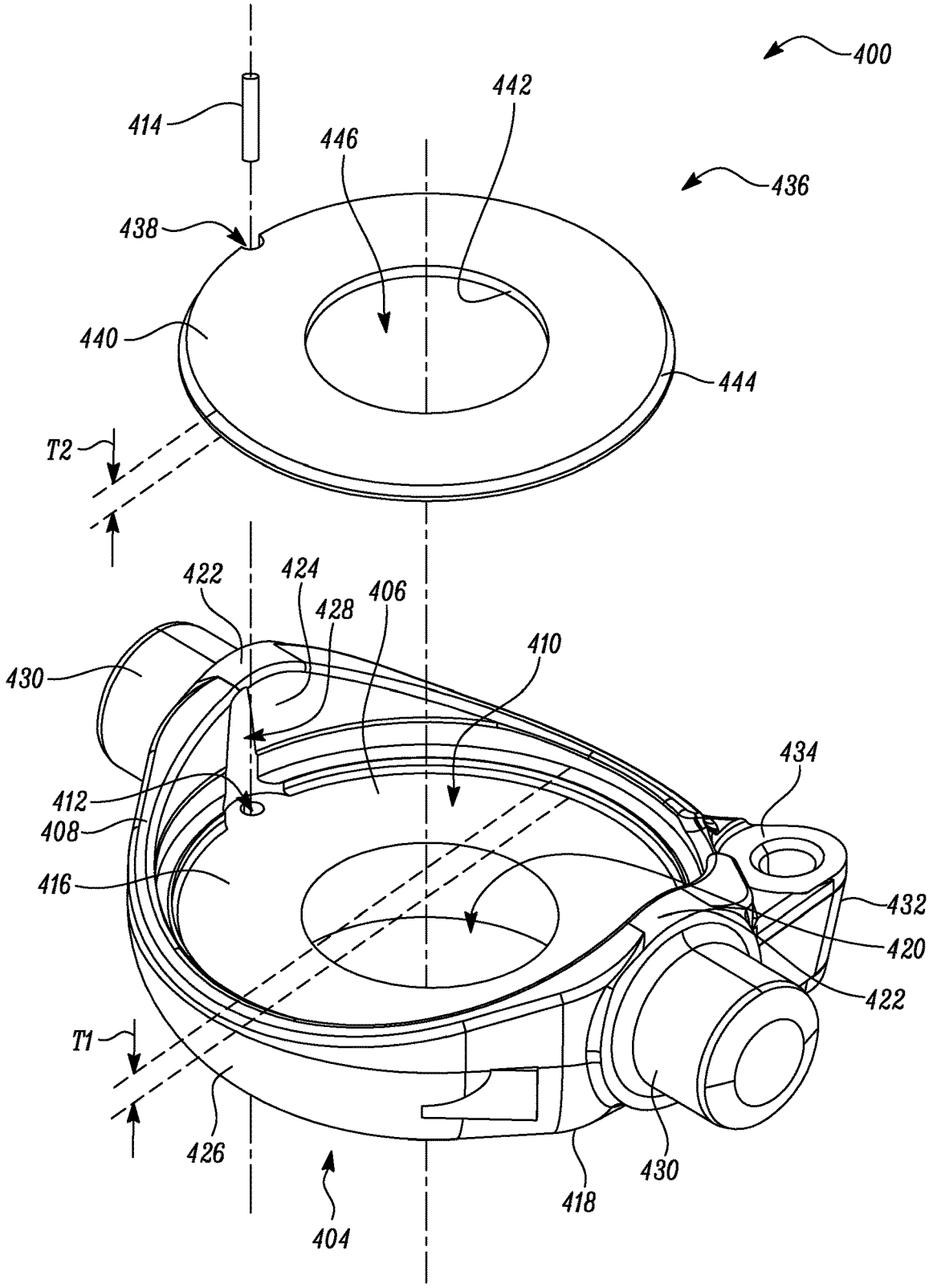
FIG. 6 is an exploded view of the remanufactured yoke of FIG. 2.

Referring now to FIGS. 5 and 6, the remanufactured yoke 400 also includes a wear plate 436 removably disposed within the receiving space 410 defined by the base 406 and the sidewall 408. The wear plate 436 has a thickness T2 that is substantially equal to the thickness T1 of the predetermined layer of material L1 (see FIG. 3) that is removed from the core yoke 300 (see FIG. 3) to form the body 404 of the remanufactured yoke 400.

It should be noted that the wear plate 436 is made of a material that is similar in material properties, such as hardness, surface cleanliness, and surface texture, to the predetermined layer of material L1 that is removed from the core yoke 300. The wear plate 436 is made of a metallic material having a Rockwell hardness value of at least 45, without any limitations. In some examples, the wear plate 436 may have a Rockwell hardness value of 48 or 54, without any limitations. It should be noted that a hardness and the material of the wear plate 436 may vary based on application requirements. Further, the Rockwell hardness value of the wear plate 436 may be at least equal to or greater than a Rockwell hardness value of the body 404. In some examples, the Rockwell hardness value of the wear plate 436 may be at least equal to or greater than a Rockwell hardness value of the predetermined layer of material L1. In some examples, the wear plate 436 may be made of cast iron.

Further, the wear plate 436 defines a cut-out 438 to at least partially receive the coupling member 414 therein. The cut-out 438 has an arcuate shape herein. It should be noted that, when the wear plate 436 is received within the body 404, the wear plate 436 is rotated by 180 degrees from the orientation that is shown in FIG. 5.

The wear plate 436 is annular in shape. Specifically, the wear plate 436 includes an annular body 440. The annular body 440 defines an inner plate surface 442 and an outer plate surface 444. The cut-out 438 in the wear plate 436 is defined at the outer plate surface 444. The wear plate 436 also defines a second central opening 446. The second central opening 446 is in communication with the inner plate surface 442.

Referring now to FIG. 6, the remanufactured yoke 400 includes the coupling member 414. The coupling member 414 is coupled with the body 404 and the wear plate 436 to prevent a rotational movement of the wear plate 436 relative to the body 404, such as, about the pump axis 206 (see FIG. 2). As shown in FIG. 6, the opening 412 in the base 406 is in alignment with the cut-out 438 in the wear plate 436 to receive the coupling member 414. Further, the inner surface 424 of the sidewall 408 defines the notch 428 proximal to the opening 412 in the base 406 to allow receipt of the coupling member 414 within the cut-out 438 in the wear plate 436 and the opening 412 in the base 406. Moreover, the first central opening 420 is in alignment with the second central opening 446 to receive the wear plate 436 within the receiving space 410.

The coupling member 414 is a dowel herein. Specifically, the coupling member 414 includes a metallic dowel. However, the coupling member 414 may include any other type of fastening member that couples the wear plate 436 with the body 404 to prevent any relative rotational movement therebetween. It should be noted that the wear plate 436 and the coupling member 414 may include a design different from what is illustrated and explained in this disclosure, as per application requirements. Further, the yoke 400 may include additional components in addition to those explained herein.

Figure 7:
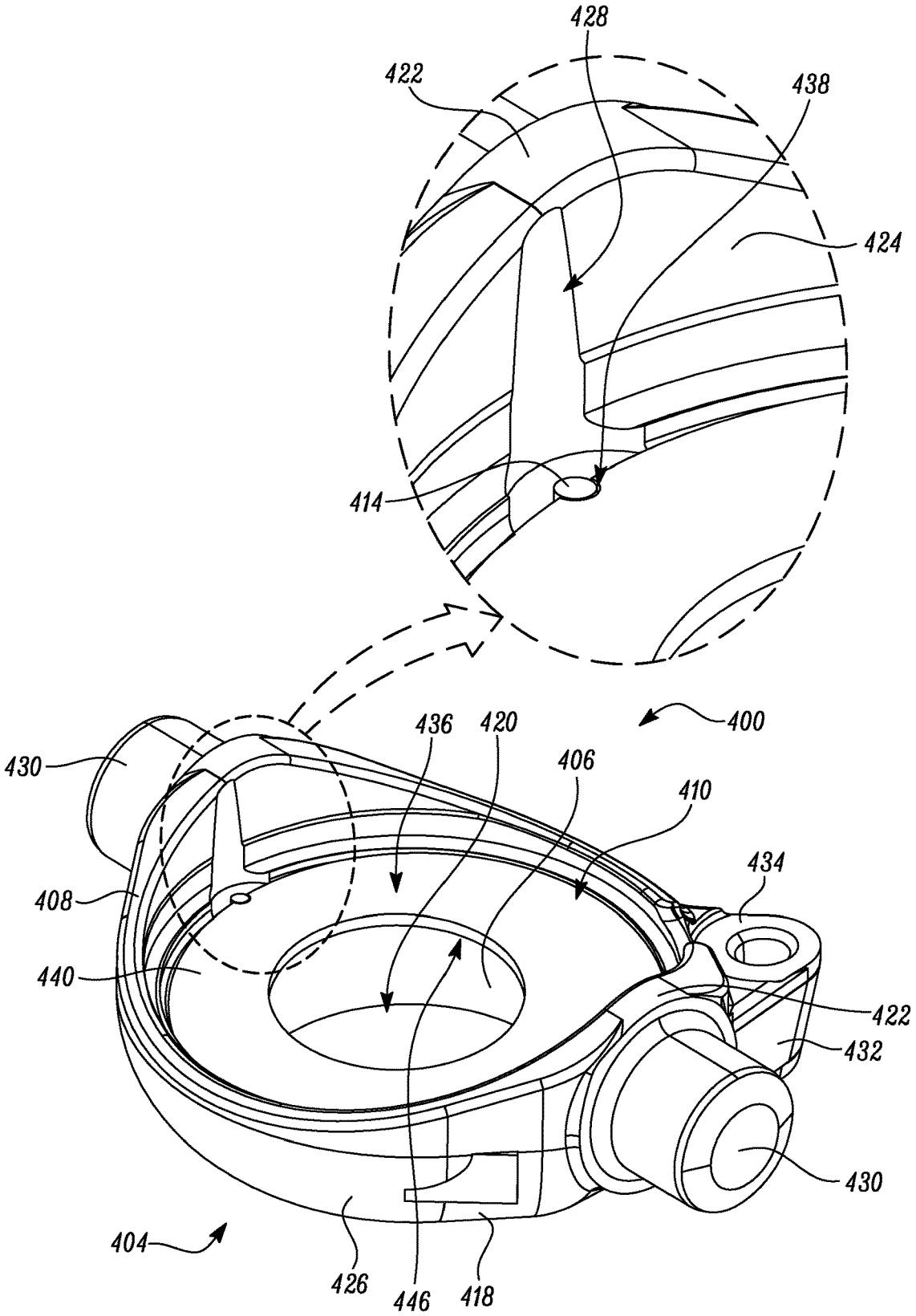
FIG. 7 is a schematic perspective view of the remanufactured yoke of FIG. 2.

Referring now to FIG. 7, when coupled with the body 404, the wear plate 436 is in contact with the base 406 of the body 404. Specifically, when the wear plate 436 is received within the receiving space 410, the wear plate 436 is disposed on the base 406 and contacts the upper surface 416 (see FIG. 6) of the base 406. When the wear plate 436 is coupled with the body 404, the second central opening 446 aligns with the first central opening 420 of the base 406.

Furthermore, when the coupling member 414 is coupled with the body 404 and the wear plate 436, a portion of the coupling member 414 is received within and engages with the cut-out 438 of the wear plate 436 to prevent a rotation of the wear plate 436 with respect to the body 404. Moreover, when the coupling member 414 is coupled with the body 404 and the wear plate 436, a portion of the coupling member 414 is received within the opening 412 in the body 404. In some examples, the coupling member 414 may be coupled with the base 406 of the body 404 by an interference fit. In other examples, the coupling member 414 may have external threads (not shown) and a slot (not shown) formed in its exposed end, the slot being sized to accommodate a screwdriver blade for rotating the coupling member, and the base 406 may have internal threads (not shown) to removably couple the coupling member 414 with the base 406.

It is to be understood that individual features shown or described for one embodiment may be combined with individual features shown or described for another embodiment. The above described implementation does not in any way limit the scope of the present disclosure. Therefore, it is to be understood although some features are shown or described to illustrate the use of the present disclosure in the context of functional segments, such features may be omitted from the scope of the present disclosure without departing from the spirit of the present disclosure as defined in the appended claims.

INDUSTRIAL APPLICABILITY

The present disclosure is related to the remanufactured yoke 400. The remanufactured yoke 400 includes the wear plate 436 that can be disposed after removal of the damaged portions 302 from the initial/core yoke 300. For example, when a top surface of the core yoke 300 becomes worn or damaged, the wear plate 436 may be installed to allow reuse of the core yoke 300 as the remanufactured yoke 400. Specifically, the layer of material L1 containing the damaged portions 302 may be removed from the core yoke 300 on initial salvage reclaim, after which the wear plate 436 and the coupling member 414 may be coupled with the body 404.

Further, the wear plate 436 and/or the coupling member 414 may be replaced once damaged. Thus, the wear plate 436 may act as a sacrificial component that can be replaced on damage. This approach may reduce service and maintenance costs, as only the wear plate 436 may have to be replaced instead of replacing the entire yoke. The wear plate 436 has a simple design and is easy to assemble, which may improve serviceability and maintenance of the fuel pump 200. Further, the wear plate 436 includes the cut-out 438 that acts as an alignment feature for accurately positioning the wear plate 436 relative to the body 404, thereby eliminating requirement of alignment features in the wear plate 436 or additional tools/techniques for alignment.

Figure 8:
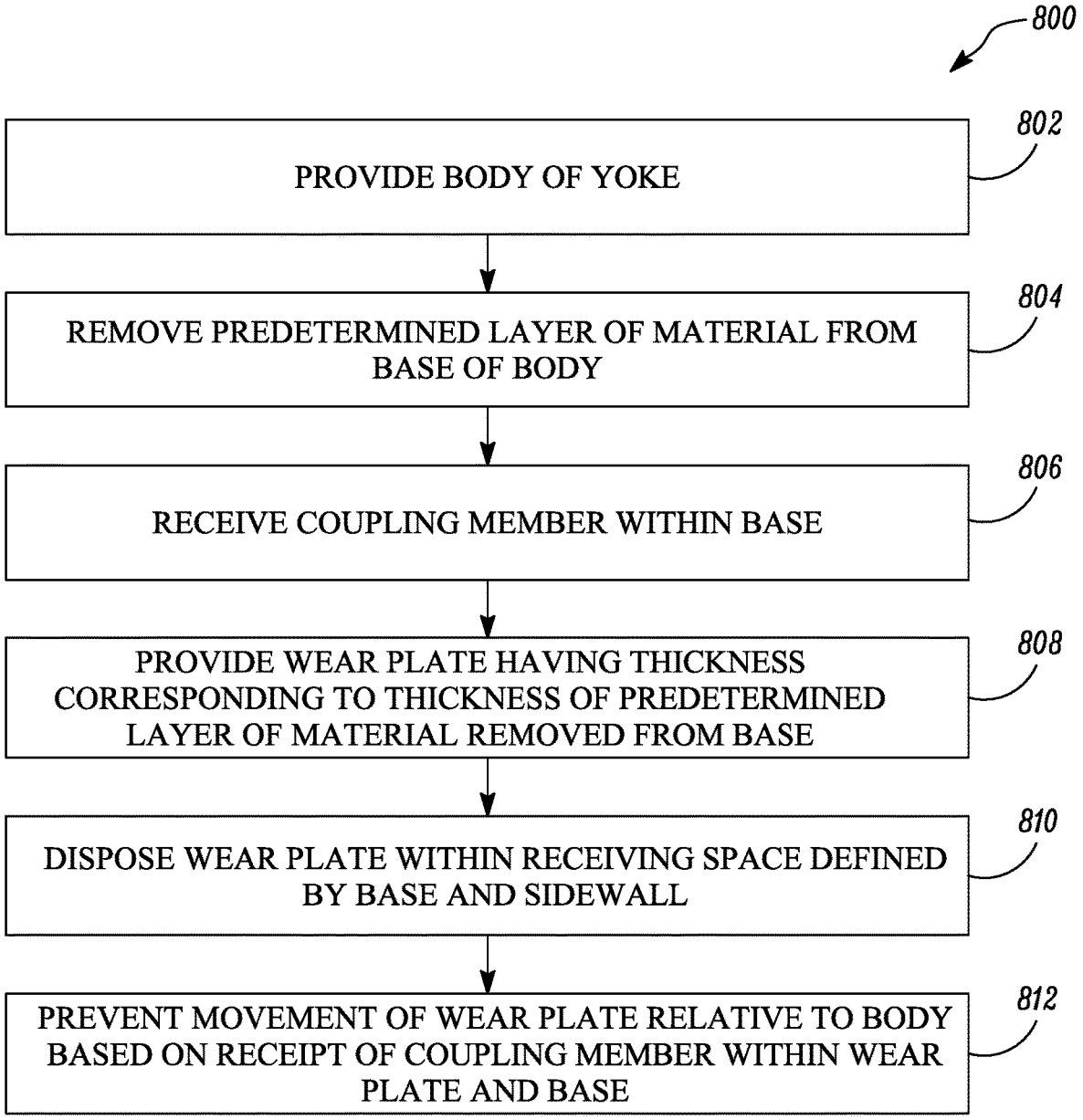
FIG. 8 is a flowchart for a method of remanufacturing the yoke for the fuel pump, according to an example of the present disclosure.

FIG. 8 is a flowchart for a method 800 of remanufacturing the yoke 400 for the fuel pump 200. Referring to FIGS. 3 to 8, at step 802, the body 404 of the yoke 400 is provided. The body 404 has the base 406 and the sidewall 408 extending orthogonally from the base 406. The base 406 and the sidewall 408 together define the receiving space 410.

At step 804, the predetermined layer of material L1 is removed from the base 406 of the body 404. At step 806, the coupling member 414 is received within the base 406. At step 808, the wear plate 436 having the thickness T2 corresponding to the thickness T1 of the predetermined layer of material L1 removed from the base 406 is provided.

At step 810, the wear plate 436 is disposed within the receiving space 410 defined by the base 406 and the sidewall 408, such that the wear plate 436 contacts the base 406 of the body 404 and the coupling member 414. At step 812, the rotational movement of the wear plate 436 relative to the body 404 is prevented based on receipt of the coupling member 414 within the wear plate 436 and the base 406.

The method 800 further includes a step (not shown) at which the opening 412 is provided in the base 406 of the body 404. Further, the wear plate 436 defines the cut-out 438. Furthermore, the step of disposing the wear plate 436 within the receiving space 410 defined by the base 406 and the sidewall 408 further includes a step (not shown) at which the cut-out 438 in the wear plate 436 is aligned with the coupling member 414. The wear plate 436 includes the annular body 440. The annular body 440 defines the inner plate surface 442 and the outer plate surface 444. The cut-out 438 in the wear plate 436 is defined at the outer plate surface 444. Further, the wear plate 436 is made of the metallic material having the Rockwell hardness value of at least 45.

Further, the sidewall 408 defines the inner surface 424 facing the receiving space 410 and an outer surface 426 opposite the inner surface 424. Furthermore, the method 800 includes a step (not shown) at which the notch 428 is provided on the inner surface 424 of the sidewall 408 to allow receipt of the coupling member 414 within the opening 412 in the base 406. The notch 428 is proximal to the opening 412 in the base 406.

The method 800 described herein may be cost effective, simple, and a time-effective method of remanufacturing the yoke 400, without requiring additional/complex set-ups.

It may be desirable to perform one or more of the steps shown in FIG. 8 in an order different from that depicted. Furthermore, various steps could be performed together.

Unless explicitly excluded, the use of the singular to describe a component, structure, or operation does not exclude the use of plural such components, structures, or operations or their equivalents. The use of the terms "a" and "an" and "the" and "at least one" or the term "one or more," and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B" or one or more of A and B") is to be construed to mean one item selected from the listed items (A or B) or any combination of two or more of the listed items (A and B; A, A and B; A, B and B), unless otherwise indicated herein or clearly contradicted by context. Similarly, as used herein, the word "or" refers to any possible permutation of a set of items. For example, the phrase "A, B, or C" refers to at least one of A, B, C, or any combination thereof, such as any of: A; B; C; A and B; A and C; B and C; A, B, and C; or multiple of any item such as A and A; B, B, and C; A, A, B, C, and C; etc.

While aspects of the present disclosure have been particularly shown and described with reference to the embodiments above, it will be understood by those skilled in the art that various additional embodiments may be contemplated by the modification of the disclosed work machine, systems and methods without departing from the spirit and scope of the disclosure. Such embodiments should be understood to fall within the scope of the present disclosure as determined based upon the claims and any equivalents thereof.

The invention claimed is:

1. A remanufactured yoke for a fuel pump, the remanufactured yoke comprising:

a body having a base and a sidewall extending orthogonally from the base, the base and the sidewall together defining a receiving space, the sidewall defining an inner surface facing the receiving space and an outer surface opposite the inner surface;

a wear plate removably disposed within the receiving space defined by the base and the sidewall, wherein the wear plate is in contact with the base of the body; and a coupling member coupled with the body and the wear plate to prevent a rotational movement of the wear plate relative to the body, wherein the base defines an opening to at least partially receive the coupling member therein, the wear plate defines a cut-out to at least partially receive the coupling member therein, and the opening in the base is in alignment with the cut-out in the wear plate to receive the coupling member, and wherein the inner surface of the sidewall defines a notch in communication with the receiving space to allow receipt of the coupling member in the wear plate, and the notch is proximal to the opening in the base to allow receipt of the coupling member within the cut-out in the wear plate and the opening in the base.

2. The remanufactured yoke of claim 1, wherein the coupling member is a dowel.

3. The remanufactured yoke of claim 2, wherein the dowel is a metallic dowel.

4. The remanufactured yoke of claim 1, wherein the wear plate includes an annular body, the annular body defines an inner plate surface and an outer plate surface, and wherein the cut-out in the wear plate is defined at the outer plate surface.

5. The remanufactured yoke of claim 1, wherein the wear plate is made of a metallic material having a Rockwell hardness value of at least 45.

6. The remanufactured yoke of claim 1, wherein the notch at least partially surrounds the opening.

7. A fuel pump comprising:

a pump housing; and a remanufactured yoke removably coupled to the pump housing and pivotable about a yoke axis, the remanufactured yoke including:

a body having a base and a sidewall extending orthogonally from the base, the base and the sidewall together defining a receiving space, the sidewall defining an inner surface facing the receiving space and an outer surface opposite the inner surface;

a wear plate removably disposed within the receiving space defined by the base and the sidewall, wherein the wear plate is in contact with the base of the body; and a coupling member coupled with the body and the wear plate to prevent a rotational movement of the wear plate relative to the body, wherein the base defines an opening to at least partially receive the coupling member therein, the wear plate defines a cut-out to at least partially receive the coupling member therein, and the opening in the base is in alignment with the cut-out in the wear plate to receive the coupling member, and wherein the inner surface of the sidewall defines a notch in communication with the receiving space to allow receipt of the coupling member in the wear plate, and the notch is proximal to the opening in the base to allow receipt of the coupling member within the cut-out in the wear plate and the opening in the base.

8. The fuel pump of claim 7, wherein the coupling member is a dowel.

9. The fuel pump of claim 8, wherein the dowel is a metallic dowel.

10. The fuel pump of claim 7, wherein the wear plate includes an annular body, the annular body defines an inner plate surface and an outer plate surface, and wherein the cut-out in the wear plate is defined at the outer plate surface.

11. The fuel pump of claim 7, wherein the wear plate is made of a metallic material having a Rockwell hardness value of at least 45.

12. The fuel pump of claim 7, wherein the notch at least partially surrounds the opening.

13. An engine system, comprising:

a body having a base and a sidewall extending from the base, the base and the sidewall together defining a receiving space, the sidewall defining an inner surface facing the receiving space and an outer surface opposite the inner surface;

a wear plate removably disposed within the receiving space defined by the base and the sidewall; and a coupling member coupled with the body and the wear plate to prevent a rotational movement of the wear plate relative to the body, wherein the base defines an opening, the wear plate defines a cut-out, and the opening in the base is in alignment with the cut-out in the wear plate to receive the coupling member, and wherein the inner surface of the sidewall defines a notch proximal to the opening in the base to allow receipt of the coupling member within the cut-out in the wear plate and the opening in the base.

14. The engine system of claim 13, wherein the coupling member is a dowel.

15. The engine system of claim 14, wherein the dowel is a metallic dowel.

16. The engine system of claim 13, wherein the wear plate is made of a material having a Rockwell hardness value of at least 45.

17. The engine system of claim 13, wherein the wear plate defines the cut-out to at least partially receive the coupling member therein.

18. The engine system of claim 13, wherein the wear plate includes a portion defining an inner plate surface and an outer plate surface, and wherein the cut-out in the wear plate is defined at the outer plate surface.

19. The engine system of claim 13, wherein the notch at least partially surrounds the opening.

* * * * *